US005184826A

United States Patent [19]

Hall, Jr.

[11] Patent Number: 5,184,826

[45] Date of Patent: Feb. 9, 1993

[54] GOLF SWING TRAINING DEVICE

[76] Inventor: Carroll L. Hall, Jr., 413 Church St., Baltimore, Md. 21225

[21] Appl. No.: 879,312

[22] Filed: May 7, 1992

[51] Int. Cl.[5] ..... A63B 69/36

[52] U.S. Cl. ..... 273/186.2; 273/194 R

[58] Field of Search ..... 273/186.2, 186.3, 187.4, 273/187.5, 29 A, 26 B, 194 R

[56] References Cited

U.S. PATENT DOCUMENTS 3,918,721 11/1975 Trask ..... 273/186.2
4,789,160 12/1988 Dollar et al. ..... 273/186.2
4,911,441 3/1990 Brunner ..... 273/29 A

*Primary Examiner*—George J. Marlo
*Attorney, Agent, or Firm*—Morton J. Rosenberg; David I. Klein

[57] ABSTRACT

A golf swing training device (100) is provided for aiding a golfer in developing a proper golf swing. The golf swing training device (100) includes a housing (110) releasably coupled to the shaft portion of a golf club (10). Within the housing (110) there is provided an electrical circuit (112) having a pair of angularly disposed position sensors (120, 130), coupled in series relation to complete a circuit for energizing an audio transducer (140) responsive to golf club (10) being properly positioned parallel to the base surface (20) to indicate the proper backswing position.

20 Claims, 1 Drawing Sheet

GOLF SWING TRAINING DEVICE

BACKGROUND OF THE INVENTION

1. Field of the Invention

This invention directs itself to training devices for use by golfers. In particular, this invention directs itself to a training device for aiding a golfer in developing a proper backswing. Still further, this invention directs itself to a golf swing training device having a position sensitive circuit for indicating when the golf club has been rotated during the backswing to a position substantially parallel with a base surface. More in particular, this invention directs itself to a golf swing training device having a position sensitive circuit incorporating a pair of angularly disposed position sensors for detecting the substantially parallel position of the golf club during the backswing. Further, this invention directs itself to a position sensitive circuit having an audio transducer which is energized responsive to the golf club position being substantially parallel to the base surface.

2. Prior Art

Athletic training devices having position sensitive circuits are well known in the art. The best prior art known to the Applicant include U.S. Pat. Nos. 2,919,491; 2,919,922; 2,976,046; 2,995,375; 3,242,582; 3,306,618; 3,429,526; 4,079,520; 4,179,125; 4,482,155; 4,515,368; 4,580,350; 4,789,160; 4,830,377; 4,911,441; 4,930,787; 4,934,706; 4,993,710; and, 5,056,783.

Some prior art systems such as that disclosed in U.S. Pat. No. 4,911,441 are directed to training devices having multiple mercury switches and audio transducers for indicating proper and improper swinging of a bat. However, such systems do not provide multiple mercury switches angularly positioned with respect to the longitudinal axis of the instrumentality being swung to indicate when such axis is substantially parallel to a base surface.

In other prior art systems such as that disclosed in U.S. Pat. Nos. 4,930,787; 4,789,160; and, 4,515,368, electrically powered training devices are disclosed for coupling to golf clubs. However, such systems do not disclose or suggest a pair of serially coupled angularly disposed position sensitive switches for providing an indication of when the golf club is substantially parallel to a base surface during a golfer's backswing.

SUMMARY OF THE INVENTION

A golf swing training device for aiding a golfer to develop a proper backswing when hitting a golf ball from a base surface is provided. The golf swing training device includes a housing releasably coupled to the golf club. The golf swing training device further includes a circuit assembly disposed within the housing for providing an audio signal responsive to the golf club being positioned substantially parallel to the base surface.

DESCRIPTION OF THE PREFERRED EMBODIMENTS

Figure 1:
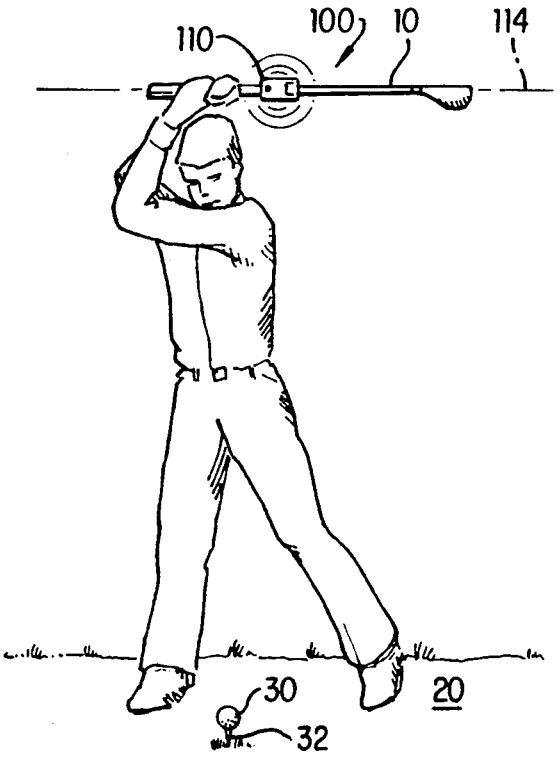
FIG. 1 is perspective view of the golf swing training device in use.
Figure 2:
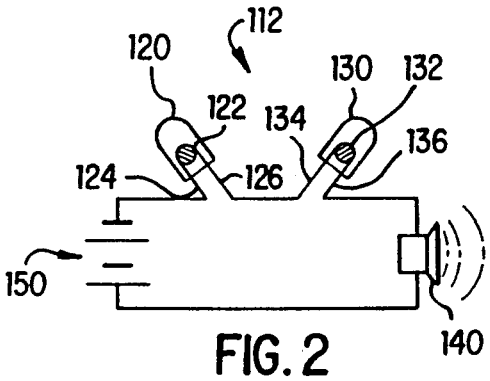
FIG. 2 is a schematic circuit diagram of the golf swing training device.
Figure 3A:
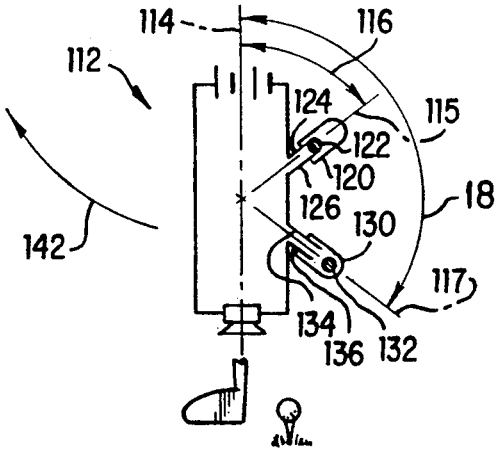
FIG. 3A is a schematic representation of the golf swing training device positioned at 0 degrees.
Figure 3B:
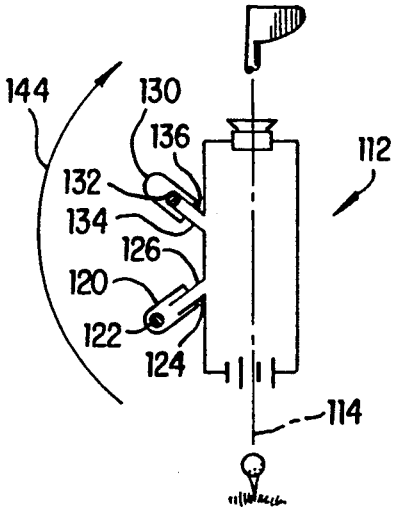
FIG. 3B is a schematic representation of the golf swing training device positioned at 180 degrees; and, FIG. 3C is a schematic representation of the golf swing training device positioned at 270 degrees.
Figure 3C:
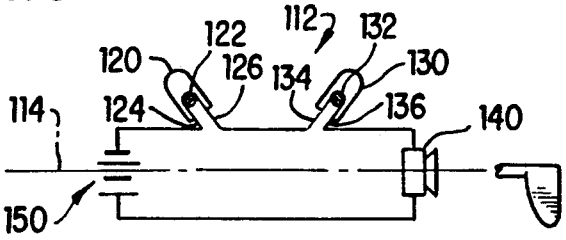

Referring now to FIGS. 1-3, there is shown golf swing training device 100 for aiding a golfer in developing a proper golf swing when hitting a golf ball from a base surface 20. As will be seen in following paragraphs, golf swing training device 100 is specifically directed to providing an audio indication of proper golf club position during the backswing. Training device 100 may have application in sports activities other than golf, such as in tennis, wherein it is desirable that the tennis racket be maintained substantially parallel to the ground surface during a portion of the racket stroke. However, training device 100 is particularly adapted for use in golf, to aid in developing the proper golf swing for hitting golf ball 30 from the golf tee 32.

Referring to FIG. 1, there is shown golf training device 100 coupled to the golf club 10. Golf training device 100 is provided within a housing 110 releasably coupled to the shaft of golf club 10 such that the training device 100 has its longitudinal axis aligned with the axial axis 114 of the golf club shaft. Although not important to the inventive concept, golf training device 100 may be releasably coupled to golf club 10 by any of a plurality of means well known in the art, such as by spring biased clamps, straps, or hook and loop type fasteners. When the golfer addresses the golf ball 30, disposed on the tee 32, it is known to be desirable to have a golf swing where the golfer extends his backswing such that the club axis 114 is substantially parallel with the ground or base surface 20 for maximizing the force delivered to the golf ball 30. Golf swing training device 100 is provided with a pair of position sensors to detect when the golf club axis 114 has reached the appropriate position, for enabling the output of an audio signal to alert the golfer that the golf club is properly positioned.

Referring to FIG. 2, there is shown the training device position sensitive circuit 112 for generating an audio signal responsive to the golf club being positioned substantially parallel to base surface 20. The circuit 112 includes a pair of angularly disposed position sensors 120 and 130, each being disposed at an angle approximately 90 angular degrees apart. First position sensor 120 includes a first connection terminal 124 coupled to one end of a D.C. power supply 150. D.C. power supply 150 may be a primary or secondary battery source, or any source of D.C. power, such as may be provided by solar cells. First position sensor 120 further includes a second connection terminal 126 which is serially coupled with a first connection terminal 134 of second position sensor 130. Second position sensor 130 further includes a second connection terminal 136 coupled to one input terminal of the audio transducer 140. Audio transducer 140 includes a second input terminal coupled to the opposing end of D.C. power source 150, such that when the respective connection terminals 124, 126 and 134, 136 provide conductive paths therebetween, responsive to the circuit 112 being positioned substantially parallel to the base surface 20, an electrical path is completed from power source 150 to audio transducer 140, to thereby generate an audio signal to alert the golfer that the club has been positioned properly. Position sensors 120 and 130 may be single pole mercury switches, such as those having the manufacturer's designation, Model #275-040 available from Radio Shack. Mercury switches 120, 130 each includes a droplet of liquid mercury 122, 132 for bridging between the respective connection terminals 124 and 126, 134 and 136 to complete the electrical path between D.C. power source 150 and audio transducer 140. Audio transducer 140 may be provided in the form of a buzzer, piezoelectric sounder, or in the form of an audio oscillator and speaker combination, as is well known in the art and commercially available from a plurality of sources.

Referring to FIG. 3A, there is shown, a schematic representation of the position sensitive circuit 112 oriented such that the axial axis of the golf club shaft 114 is directed vertically with the golf club head being oriented toward the base surface. Position sensor 120 is disposed with its longitudinal axis 115 oriented at approximately 45 degrees with respect to the golf club axis 114, as indicated by the directional arrow 116 and extending in a plane substantially orthogonal with respect to the plane of the ball striking face of the golf club head. Similarly, position sensor 130 is disposed with its longitudinally extended axis 117 oriented approximately 90 degrees from the longitudinal axis 115 of position sensor 120. Thus, the longitudinal axis 117 of position sensor 130 is disposed at an angle of approximately 135 degrees with respect to the axial axis 114, as indicated by directional arrow 18, of the golf club shaft and extends in substantially the same plane as sensor 120. With the position sensors 120 and 130 positioned in this way, the connecting terminals 124 and 126 would be bridged by the mercury droplet 122, closing the circuit therebetween, while the mercury droplet 132 would be disposed away from the connecting terminals 134 and 136, maintaining that circuit in an open condition. Thus, in the position shown in FIG. 3A, no audio tone would be generated. As the golfer began his swing, the club would be rotated, as indicated by directional arrow 142.

As the golf swing progressed, the axial axis 114 of golf club 10 would rotate through 180 degrees, as indicated by directional arrow 144. The position sensitive circuit 112 would likewise be rotated through 180 degrees. In this position, the mercury droplet 122 is disposed away from the connecting terminals 124 and 126, providing an open circuit therebetween, while the mercury droplet 132 would provide a conductive path between the connecting terminals 134 and 136. Since the position sensor 120 provides an open circuit between connecting terminals 124 and 126, the audio transducer is not energized.

Further rotation of the golf club from the position shown in FIG. 3B defines the backswing portion of the golf club motion for driving the golf ball. When properly oriented, the axial axis 114 of the golf club is substantially parallel to the base surface 20, and the mercury droplets 122 and 132 are each respectively disposed between connecting terminals 124, 126 and 134, 136 to provide a conductive pathway between the power source 150 and audio transducer 140 to aurally indicate that the golf club has been properly positioned. The golfer is thereby able to get the feel of a proper backswing, that is, how far he is required to extend the club rearwardly to place the club in the proper position. Thus, by orienting a pair of position sensors 120 and 130 such that their operative axes 115, 117 are disposed approximately 90 angular degrees apart and displaced approximately 45 angular degrees from the axial axis 114 of the golf club shaft, and oriented substantially orthogonal with respect to the ball striking surface of the golf club head, training device 100 provides an audio signal to indicate only when the golfer has brought the club to the proper backswing position.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A golf swing training device for aiding a golfer to develop a proper backswing when hitting a golf ball from a base surface with a golf club, comprising:

a golf club having a longitudinal axis;

a housing releasably coupled to said golf club; and circuit means disposed within said housing for providing an audio signal responsive to the longitudinal axis of said golf club being positioned substantially parallel to said base surface.

2. The golf swing training device as recited in claim 1 where said circuit means includes a pair of angularly disposed position sensors for detecting said substantially parallel position of said golf club.

3. The golf swing training device as recited in claim 2 where said pair of position sensors define a first position sensor and a second position sensor electrically coupled in series relation.

4. The golf swing training device as recited in claim 3 where said circuit means includes audio transducer means electrically coupled to at least one of said pair of position sensors for emitting an audio signal responsive to a voltage applied thereto.

5. The golf swing training device as recited in claim 4 where said circuit means includes means for supplying a D.C. voltage having a first output terminal coupled to at least one of said pair of position sensors.

6. The golf swing training device as recited in claim 2 where each of said pair of position sensors is a single pole position sensitive switch.

7. The golf swing training device as recited in claim 6 where said position sensitive switch is a mercury switch.

8. The golf swing training device as recited in claim 5 where each of said pair of position sensors includes a first connection terminal and a second connection terminal, said second connection terminal of said first position sensor being electrically coupled to said first connection terminal of said second position sensor.

9. The golf swing training device as recited in claim 8 where said D.C. voltage supply first output terminal is electrically coupled to said first connection terminal of said first position sensor.

10. The golf swing training device as recited in claim 9 where said D.C. voltage supply includes a second output terminal electrically coupled to an input terminal of said audio transducer means.

11. The golf swing training device as recited in claim 10 where said audio transducer means includes another input terminal electrically coupled to said second connection terminal of said second position sensor.

12. The golf swing training device as recited in claim 3 where each of said first and second position sensors has an orientation axis disposed at an approximating angle of 45 degrees with respect to a longitudinal axis of said golf club.

13. The golf swing training device as recited in claim 12 where said first position sensor is angularly displaced with respect to said second position sensor in a single reference plane by an angle approximating 90 degrees.

14. The golf swing training device as recited in claim 5 where said D.C. power supply is a battery.

15. A golf swing training device for aiding a golfer to develop a proper backswing when hitting a golf ball from a base surface with a golf club, comprising:

a golf club having a longitudinal axis;

a housing releasably coupled to said golf club;

a power source disposed within said housing;

position sensing means disposed within said housing and having an input terminal electrically coupled to said power source for switching a voltage from said input terminal to an output terminal responsive to the longitudinal axis of said golf club being positioned substantially parallel to said base surface; and, audio transducer means coupled to said output terminal of said position sensing means for emitting an audio signal responsive to said voltage being switched to said output terminal.

16. The golf swing training device as recited in claim 15 where said position sensing means includes a first and second position sensitive switch electrically coupled in series relation one with respect to the other.

17. The golf swing training device as recited in claim 16 where said first and second position sensitive switches are (1) disposed in substantially parallel relation in two coordinate directions, and (2) angularly disposed one relative to the other in a third coordinate direction.

18. The golf swing training device as recited in claim 17 where each of said first and second position sensitive switch has an orientation axis disposed at an approximating angle of 45 degrees with respect to a longitudinal axis of said golf club.

19. The golf swing training device as recited in claim 18 where said first position sensitive switch is angularly displaced with respect to said second position sensitive switch in said third coordinate direction by an angle approximating 90 degrees.

20. The golf swing training device as recited in claim 16 where each of said first and second position sensitive switch is a mercury switch.

* * * * *